US006935864B2

(12) United States Patent
Shechter et al.

(10) Patent No.: US 6,935,864 B2
(45) Date of Patent: Aug. 30, 2005

(54) FIREARM LASER TRAINING SYSTEM AND METHOD EMPLOYING MODIFIED BLANK CARTRIDGES FOR SIMULATING OPERATION OF A FIREARM

(75) Inventors: Motti Shechter, Potomac, MD (US); Stephen P. Rosa, Ellicott City, MD (US)

(73) Assignee: Beamhit, LLC, Columbia, MD (US)

( * ) Notice: Subject to any disclaimer, the term of this patent is extended or adjusted under 35 U.S.C. 154(b) by 188 days.

(21) Appl. No.: 10/388,521

(22) Filed: Mar. 17, 2003

(65) Prior Publication Data

US 2003/0175661 A1 Sep. 18, 2003

Related U.S. Application Data

(62) Division of application No. 09/760,611, filed on Jan. 16, 2001, now Pat. No. 6,572,375.
(60) Provisional application No. 60/175,954, filed on Jan. 13, 2000.

(51) Int. Cl.[7] ..... F41G 3/26
(52) U.S. Cl. ..... 434/19; 434/22
(58) Field of Search ..... 434/16, 19–22; 42/114–116

(56) References Cited

U.S. PATENT DOCUMENTS

| | | | |
|---|---|---|---|
| 2,023,497 | A | 12/1935 | Trammell |
| 2,934,634 | A | 4/1960 | Hellberg |
| 3,452,453 | A | 7/1969 | Ohlund |
| 3,510,965 | A | 5/1970 | Rhea |
| 3,526,972 | A | 9/1970 | Sumpf |
| 3,590,225 | A | 6/1971 | Murphy |
| 3,633,285 | A | 1/1972 | Sensney |
| 3,782,832 | A | 1/1974 | Hacskaylo |
| 3,792,535 | A | 2/1974 | Marshall et al. |
| 3,916,536 | A | 11/1975 | Mohon et al. |
| 3,938,262 | A | 2/1976 | Dye et al. |
| 3,995,376 | A | 12/1976 | Kimble et al. |
| 3,996,674 | A | 12/1976 | Pardes et al. |
| 4,048,489 | A | 9/1977 | Giannetti |
| 4,063,368 | A | 12/1977 | McFarland et al. |
| 4,102,059 | A | 7/1978 | Kimble et al. |
| 4,164,081 | A | 8/1979 | Berke |
| 4,177,580 | A | 12/1979 | Marshall et al. |
| 4,195,422 | A | 4/1980 | Budmiger |
| 4,222,564 | A | 9/1980 | Allen et al. |
| 4,256,013 | A | 3/1981 | Quitadama |
| 4,269,415 | A | 5/1981 | Thorne-Booth |
| 4,281,993 | A | 8/1981 | Shaw |
| 4,290,757 | A | 9/1981 | Marshall et al. |
| 4,313,272 | A | 2/1982 | Matthews |
| 4,313,273 | A | 2/1982 | Matthews et al. |

(Continued)

FOREIGN PATENT DOCUMENTS

| | | |
|---|---|---|
| DE | 3537323 | 4/1987 |
| DE | 3631081 A1 | 3/1988 |
| DE | 3925640 A1 | 2/1991 |

(Continued)

*Primary Examiner*—Kien Nguyen
(74) *Attorney, Agent, or Firm*—Edell, Shapiro & Finnan

(57) ABSTRACT

A firearm laser training system according to the present invention includes a laser transmitter assembly and a cartridge adapter assembly, while employing modified blank cartridges to simulate firearm operation. The modified blank cartridges each have a quantity of explosive substance sufficient only to cycle the firearm. The laser assembly is configured for attachment to a firearm barrel and front sight and emits a beam of laser light toward a training system target in response to actuation of the firearm trigger. The laser beam is generally in the form of a pulse having a duration sufficient for the system target to detect a beam impact location. The cartridge assembly is disposed within the firearm barrel to adapt the firearm for compatibility with the modified blank cartridges for simulating firearm operation.

4 Claims, 3 Drawing Sheets

U.S. PATENT DOCUMENTS

| | | | |
|---|---|---|---|
| 4,336,018 | A | 6/1982 | Marshall et al. |
| 4,340,370 | A | 7/1982 | Marshall et al. |
| 4,352,665 | A | 10/1982 | Kimble et al. |
| 4,367,516 | A | 1/1983 | Jacob |
| 4,452,458 | A | 6/1984 | Timander et al. |
| 4,553,943 | A | 11/1985 | Ahola et al. |
| 4,561,849 | A | 12/1985 | Eichweber |
| 4,572,509 | A | 2/1986 | Sitrick |
| 4,583,950 | A | 4/1986 | Schroeder |
| 4,592,554 | A | 6/1986 | Gilbertson |
| 4,619,616 | A | 10/1986 | Clarke |
| 4,640,514 | A | 2/1987 | Myllyla et al. |
| 4,657,511 | A | 4/1987 | Allard et al. |
| 4,662,845 | A | 5/1987 | Gallagher et al. |
| 4,678,437 | A | 7/1987 | Scott et al. |
| 4,680,012 | A | 7/1987 | Morley et al. |
| 4,695,256 | A | 9/1987 | Eichweber |
| 4,737,106 | A | 4/1988 | Laciny |
| 4,761,907 | A | 8/1988 | De Bernardini |
| 4,786,058 | A | 11/1988 | Baughman |
| 4,788,441 | A | 11/1988 | Laskowski |
| 4,804,325 | A | 2/1989 | Willits et al. |
| 4,811,955 | A | 3/1989 | De Bernardini |
| 4,825,258 | A | 4/1989 | Whitson |
| 4,830,617 | A | 5/1989 | Hancox et al. |
| 4,864,515 | A | 9/1989 | Deck |
| 4,898,391 | A | 2/1990 | Kelly et al. |
| 4,922,401 | A | 5/1990 | Lipman |
| 4,923,402 | A | 5/1990 | Marshall et al. |
| 4,947,859 | A | 8/1990 | Brewer et al. |
| 4,948,371 | A | 8/1990 | Hall |
| 4,983,123 | A | 1/1991 | Scott et al. |
| 4,988,111 | A | 1/1991 | Gerlizt et al. |
| 5,004,423 | A | 4/1991 | Bertrams |
| 5,064,988 | A | 11/1991 | E'nama et al. |
| 5,092,071 | A | 3/1992 | Moore |
| 5,095,433 | A | 3/1992 | Botarelli et al. |
| 5,107,612 | A | 4/1992 | Bechtel |
| 5,119,576 | A | 6/1992 | Erning |
| 5,140,893 | A | 8/1992 | Leiter |
| 5,153,375 | A | 10/1992 | Eguizabal |
| 5,179,235 | A | 1/1993 | Toole |
| 5,194,006 | A | 3/1993 | Zaenglein, Jr. |
| 5,194,007 | A | 3/1993 | Marshall et al. |
| 5,213,503 | A | 5/1993 | Marshall et al. |
| 5,237,773 | A | 8/1993 | Claridge |
| 5,281,142 | A | 1/1994 | Zaenglein, Jr. |
| 5,328,190 | A | 7/1994 | Dart et al. |
| 5,344,320 | A | 9/1994 | Inbar et al. |
| 5,365,669 | A | 11/1994 | Rustick et al. |
| 5,366,229 | A | 11/1994 | Suzuki |
| 5,413,357 | A | 5/1995 | Schulze et al. |
| 5,433,134 | A | 7/1995 | Leiter |
| 5,474,452 | A | 12/1995 | Campagnuolo |
| 5,486,001 | A | 1/1996 | Baker |
| 5,488,795 | A | 2/1996 | Sweat |
| 5,529,310 | A | 6/1996 | Hazard et al. |
| 5,551,876 | A | 9/1996 | Koresawa et al. |
| 5,585,589 | A | 12/1996 | Leiter |
| 5,591,032 | A | 1/1997 | Powell et al. |
| 5,605,461 | A | 2/1997 | Seeton |
| 5,613,913 | A | 3/1997 | Ikematsu et al. |
| 5,641,288 | A | 6/1997 | Zaenglein, Jr. |
| 5,671,561 | A | 9/1997 | Johnson et al. |
| 5,672,108 | A | 9/1997 | Lam et al. |
| 5,685,636 | A | 11/1997 | German |
| 5,716,216 | A | 2/1998 | O'Loughlin et al. |
| 5,737,866 | A | 4/1998 | Minaire et al. |
| 5,738,522 | A | 4/1998 | Sussholz et al. |
| 5,740,626 | A | 4/1998 | Schuetz et al. |
| 5,784,823 | A | 7/1998 | Chen |
| 5,788,500 | A | 8/1998 | Gerber |
| 5,842,300 | A | 12/1998 | Cheshelski et al. |
| 5,890,906 | A | 4/1999 | Macri et al. |
| 5,947,738 | A | 9/1999 | Muehle et al. |
| 5,999,210 | A | 12/1999 | Nemiroff et al. |
| 6,028,593 | A | 2/2000 | Rosenberg et al. |
| 6,322,365 | B1 | 11/2001 | Shechter et al. |
| 2003/0136900 | A1 | 7/2003 | Shechter et al. |
| 2003/0199324 | A1 | 10/2003 | Wang |

FOREIGN PATENT DOCUMENTS

| | | | | |
|---|---|---|---|---|
| DE | 4029877 | A1 | 3/1992 | |
| DE | 4207933 | A1 | 9/1993 | |
| DE | 4233945 | A1 | 4/1994 | |
| DE | 195 19 503 | A1 | 12/1995 | |
| EP | 0072004 | A2 | 2/1983 | |
| EP | 0 285-586 | A2 | 10/1988 | |
| EP | 0 401 731 | | 6/1990 | |
| EP | 0467090 | A1 | 1/1992 | |
| FR | 2726639 | A1 | 5/1996 | |
| GB | 2141810 | A | 1/1985 | |
| GB | 2254403 | | 10/1992 | |
| GB | 2284 253 | A | 5/1995 | |
| JP | 50-22497 | | 3/1975 | |
| JP | 54-40000 | | 3/1979 | |
| JP | 56-500666 | | 12/1980 | |
| JP | 59-191100 | | 12/1984 | |
| JP | 63-502211 | | 7/1987 | |
| JP | 2-101398 | A | 4/1990 | |
| JP | 5-223500 | | 8/1993 | |
| RU | 2089832 | C1 * | 9/1997 | ..... F42B/7/02 |
| SU | 1817825 | A3 | 5/1993 | |
| WO | WO 91/09266 | | 6/1991 | |
| WO | WO 92/08093 | | 5/1992 | |
| WO | WO 94/03770 | | 2/1994 | |
| WO | WO 94/15165 | | 7/1994 | |
| WO | WO96/15420 | | 5/1996 | |
| WO | WO 99/10700 | | 3/1999 | |

* cited by examiner

FIREARM LASER TRAINING SYSTEM AND METHOD EMPLOYING MODIFIED BLANK CARTRIDGES FOR SIMULATING OPERATION OF A FIREARM

CROSS-REFERENCE TO RELATED APPLICATIONS

This application is a divisional of U.S. patent application Ser. No. 09/760,611, entitled "Firearm Laser Training System and Method Employing Modified Blank Caiiridges for Simulating Operation of a Firearm" and filed Jan. 16, 2001 now U.S. Pat. No. 6,572,375, which claims priority from U.S. Provisional Patent Application Ser. No. 60/175,954, entitled "Firearm Laser Training System Employing Modified Blank Cartridges for Simulating Operation of a Firearm" and filed Jan. 13, 2000. The disclosures of those patent applications are incorporated herein by reference in their entireties.

BACKGROUND OF THE INVENTION

1. Technical Field

The present invention pertains to firearm training systems. In particular, the present invention pertains to a firearm laser training system including a laser transmitter assembly attachable to a user firearm for projecting a laser beam therefrom and employing modified blank cartridges each having a quantity of explosive substance sufficient only to cycle the firearm to simulate firearm operation. A system cartridge adapter assembly is disposed within the firearm to enable operation of the firearm with the modified blank cartridges and laser transmitter assembly.

2. Discussion of the Related Art

Firearms are utilized for a variety of purposes, such as hunting, sporting competition, law enforcement and military operations. The inherent danger associated with firearms necessitates training and practice in order to minimize the risk of injury. However, special facilities are required to facilitate practice of handling and shooting the firearm. These special facilities basically confine projectiles propelled from the firearm within a prescribed space, thereby preventing harm to the surrounding area. Accordingly, firearm trainees are required to travel to the special facilities in order to participate in a training session, while the training sessions themselves may become quite expensive since each session requires new live ammunition for practicing handling and shooting of the firearm. Although blank cartridges may be utilized to overcome the problems associated with firearm projectiles, this type of ammunition does not provide any indication of projectile impact and may similarly incur substantial costs for a training session since each training session requires new blank cartridges. With respect to semi-automatic or fully automatic firearms, the training session costs significantly increase due to the significant quantities of live ammunition and/or blank cartridges expended by these types of firearms during those sessions.

The related art has attempted to overcome the above-mentioned problems by utilizing laser or other light energy with firearms to simulate firearm operation. For example, U.S. Pat. No. 3,633,285 (Sesney) discloses a laser transmitting device for markmanship training. The device is readily mountable to the barrel of a firearm, such as a rifle, and transmits a light beam upon actuation of the firearm firing mechanism. The laser device is triggered in response to an acoustical transducer detecting sound energy developed by the firing mechanism. The light beam is detected by a target having a plurality of light detectors, whereby an indication of aim accuracy may be obtained. Training may be extended to include the use of blank ammunition to simulate firearm recoil and noise, while live ammunition may be utilized without removing the laser device from the firearm.

U.S. Pat. No. 3,938,262 (Dye et al) discloses a laser weapon simulator that utilizes a laser transmitter in combination with a rifle to teach marksmanship by firing laser bullets at a target equipped with an infrared detector. The laser weapon includes a piezoelectric crystal coupled to a laser disposed in a housing for mounting axially to a rifle barrel. The rifle may develop a mechanical force by firing a blank cartridge which generates a shock wave and vibrates the piezoelectric device. A mechanical force may also be applied directly to the piezoelectric device by the rifle hammer.

U.S. Pat. No. 3,995,376 (Kimble et al) discloses a miniaturized laser assembly mounted on a weapon, such as an M16 rifle, where the power source and circuitry for the laser assembly are contained within the weapon. The laser weapon is fired in a normal manner by squeezing the trigger while aiming at a target. The laser emits a harmless invisible signal pulse of coherent light. The laser adapted weapon may be used with blank cartridges or live ammunition, and may further be utilized for "dry fire" (e.g., without live ammunition or blank cartridges) type exercises.

The above-described systems suffer from several disadvantages. In particular, the firearms of these systems accommodate blank cartridges and live ammunition. However, the systems generally do not provide a manner that prevents use of live ammunition during simulation modes. Accordingly, serious injury or other severe incidents may occur with these systems during firearm simulation due to accidental use of live ammunition. Further, blank cartridges for firearms typically contain quantities of explosive substance similar to or slightly less than those of live ammunition. With respect to semi-automatic or fully automatic firearms, blank cartridges for these types of firearms typically contain a significant amount of explosive substance in order to facilitate automatic firearm operation. Although the blank cartridges may cost less than and reduce training costs with respect to live ammunition, the amount of explosive substance within the blank cartridges tends to maintain costs for training sessions with these cartridges at a relatively significant level. This especially pertains to semi-automatic or automatic weapons where substantial quantities of blank cartridges may be expended during a training session.

OBJECTS AND SUMMARY OF THE INVENTION

Accordingly, it is an object of the present invention to simulate operation of an automatic type firearm.

It is another object of the present invention to simulate operation of an automatic type firearm with a modified blank cartridge having a quantity of explosive substance significantly less than that of corresponding live ammunition or blank cartridges, yet sufficient to cycle the firearm.

Yet another object of the present invention is to simulate operation of an automatic type firearm by utilizing the modified blank cartridges to cycle the firearm and generate recoil and noise and a laser transmitter assembly to indicate a projectile impact location.

Still another object of the present invention is to enhance safety of firearm simulation by preventing use of live ammunition within a firearm during simulation.

A further object of the present invention is to readily adapt an actual automatic type firearm to accommodate the modified blank cartridges for simulation of firearm operation.

The aforesaid objects are achieved individually and in combination, and it is not intended that the present invention be construed as requiring two or more of the objects to be combined unless expressly required by the claims attached hereto.

According to the present invention, a firearm laser training system includes a laser transmitter assembly and a cartridge adapter assembly, while employing modified blank cartridges to simulate firearm operation. The laser assembly is configured for attachment to a firearm barrel and front sight and emits a beam of laser light toward a training system target in response to actuation of the firearm trigger. The laser beam is generally in the form of a pulse having a duration sufficient for the system target to detect a beam impact location. The cartridge assembly is disposed within the firearm barrel to adapt the firearm for compatibility with the modified blank cartridges for simulating firearm operation.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
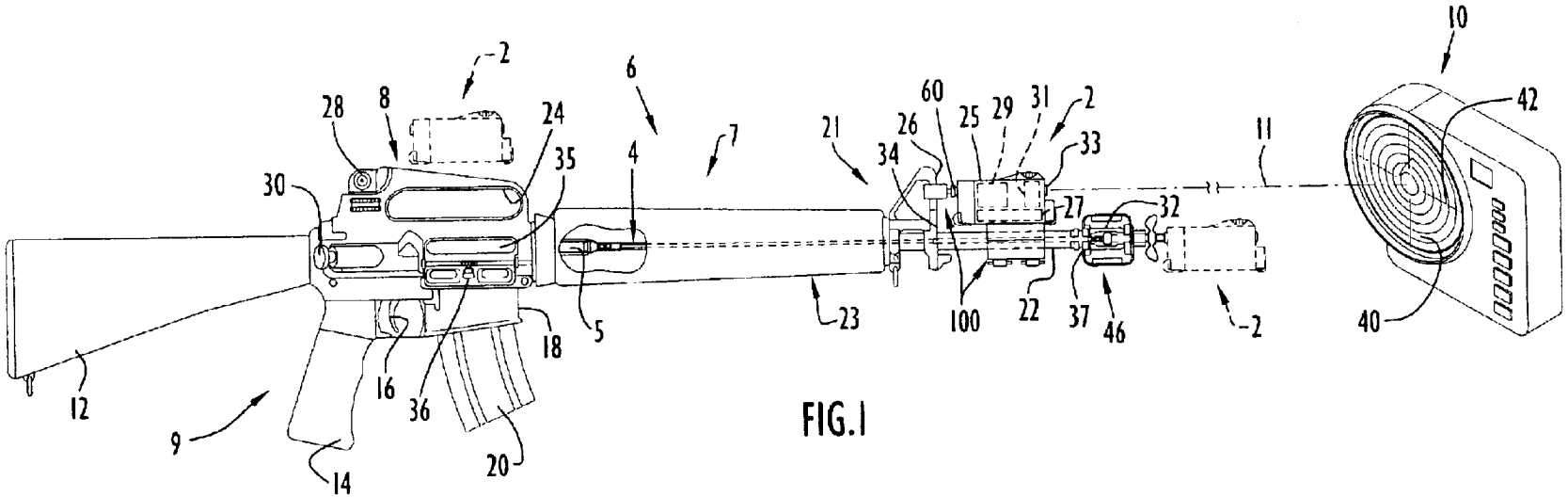
FIG. 1 is a view in perspective of a firearm laser training system directing a laser beam from a firearm onto a target according to the present invention.

A firearm laser training system according to the present invention is illustrated in FIG. 1. Specifically, the firearm laser training system includes a laser transmitter assembly 2, a cartridge adapter assembly 4, modified blank cartridges 5 and an optional target 10. The cartridge adapter assembly is disposed within a firearm 6 to adapt the firearm for compatibility with the training system. By way of example only, firearm 6 is implemented by a conventional M16 rifle having an upper half 7 and a lower half 9. However, the firearm may be implemented by any semi or fully automatic firearm. Lower half 9 includes a stock 12, a grip 14, a trigger 16 and a magazine holder 18 for receiving a magazine 20 of modified blank cartridges 5. Upper half 7 includes an upper receiver 8, a barrel assembly 21, front and rear sights 26, 28 and a flash suppressor 32. The stock is attachable to an upper receiver proximal end with grip 14, trigger 16 and magazine holder 18 being disposed distally of the stock within a lower section of the upper receiver. A charger assist 30 is disposed above grip 14 toward the upper receiver proximal end and provides assistance for correctly loading a cartridge into the firearm. Rear sight 28 is positioned above the charger assist, while a handle 24 is disposed adjacent and distally of the rear sight.

A bolt assembly and bolt carrier (not shown) are disposed within upper receiver 8 to facilitate ejection and loading of cartridges as described below. The bolt carrier is disposed in slidable relation with the upper receiver, while the bolt assembly is disposed within the bolt carrier and rotates in response to carrier motion. These components basically eject spent cartridges through an ejection port 35 disposed within the upper receiver below handle 24, and retrieve a new cartridge from magazine 20 for firing as described below. A pivotable cover 36 is attached to the upper receiver to cover the ejection port. In addition, the upper receiver includes a charging handle (not shown) for facilitating manipulation of the bolt assembly and carrier to load and/or eject a cartridge as described below.

Barrel assembly 21 includes a barrel 22 and a hand guard assembly 23. The barrel is attached to and extends distally from the upper receiver distal end, while hand guard assembly 23 is disposed about a barrel proximal end adjacent upper receiver 8. Front sight 26 is attached to the barrel distally of the hand guard assembly with flash suppressor 32 connected to the barrel distal end. The flash suppressor includes peripheral grooves 37 defined in its exterior surface toward the flash suppressor proximal end. A gas port 34 is disposed below the front sight within the barrel to direct gas created during cartridge firing toward the upper receiver through a gas tube (not shown) to manipulate the bolt assembly and carrier to cycle the firearm as described below. Laser transmitter assembly 2 is preferably attached to barrel 22 and front sight 26 via a mounting bracket 100 to project a visible or invisible (e.g., infrared) beam 11 of modulated laser light in the form of a pulse toward target 10 in response to trigger actuation. However, the laser assembly may alternatively be attached to cartridge adapter assembly 4 distally of the flash suppressor or to handle 24 of upper receiver 8 via any conventional fastening techniques (e.g., brackets, etc.). The laser beam may further be coded to enable identification of the beam source when the system is accommodating plural users.

A user aims firearm 6 at target 10 and actuates trigger 16 to project laser beam 11 from laser transmitter assembly 2 toward the target. Target 10 is used in conjunction with signal processing circuitry adapted to detect the modulated or coded laser beam. The target, by way of example, includes a circular bull's eye 40 with quadrant dividing lines 42, and detectors disposed across the target surface to detect the beam. A computer system (not shown) analyzes detection signals from the detectors and provides feedback information via a display and/or printer (not shown). The target is similar to the targets disclosed in U.S. patent application Ser. No. 09/486,342, entitled "Network-Linked Laser Target Firearm Training System" and filed Feb. 25, 2000, the disclosure of which is incorporated herein by reference in its entirety. It is to be understood that the terms "top", "bottom", "side", "front", "rear", "back", "lower", "upper", "height", "width", "thickness", "vertical", "horizontal" and the like are used herein merely to describe points of reference and do not limit the present invention to any specific configuration or orientation.

Laser transmitter assembly 2 includes a housing 25 having an internally threaded opening 60 defined in an upper portion of a housing rear wall for receiving either a component of mounting bracket 100 or a fastening device attached to cartridge assembly 4 as described below. The housing and opening may be of any shape or size, while the opening may be defined in the housing at any suitable locations. The laser assembly components are disposed within the housing and include a power source 27, typically in the form of a battery, a mechanical wave sensor 29 and an optics package 31 having a laser (not shown) and a lens 33. These components may be arranged within the housing in any suitable fashion. The optics package emits laser beam 11 through lens 33 toward target 10 or other intended target in response to detection of trigger actuation by mechanical wave sensor 29. Specifically, when trigger 16 is actuated, a firearm hammer (not shown) impacts the firearm to fire modified cartridge 5, thereby generating a mechanical wave which travels distally along barrel 22 and generally propagates throughout the firearm for detection by the laser assembly. As used herein, the term "mechanical wave" or "shock wave" refers to an impulse that travels through the firearm barrel and generally propagates throughout the firearm. Mechanical wave sensor 29 within the laser assembly senses the mechanical wave from the hammer impact and/or cartridge firing and generates a trigger signal. The mechanical wave sensor may include a piezoelectric element, an accelerometer or a solid state sensor, such as a strain gauge. Alternatively, an acoustic sensor may be employed by the laser assembly to sense actuation of the trigger.

Optics package 31 within the laser assembly generates and projects modulated laser beam 11 from firearm 6 in response to the trigger signal. The laser beam is preferably modulated at a frequency of approximately forty kilohertz, but any suitable modulation (e.g., one-hundred kilohertz) may be utilized. The optics package laser is generally enabled for a predetermined time interval, preferably in the approximate range between eight and ten milliseconds, sufficient for the target to detect the impact location. The laser assembly typically operates in either of two modes, each selectable by a mode switch (not shown). A first mode enables continuous emission of the laser beam to provide information about sight alignment and user handling of the firearm, while a second or training mode of operation emits the laser pulses in response to trigger actuation as described above to simulate firearm operation. Basically, the laser assembly in training mode is similar in function to the laser device disclosed in above-referenced U.S. patent application Ser. No. 09/486,342.

Figure 2:
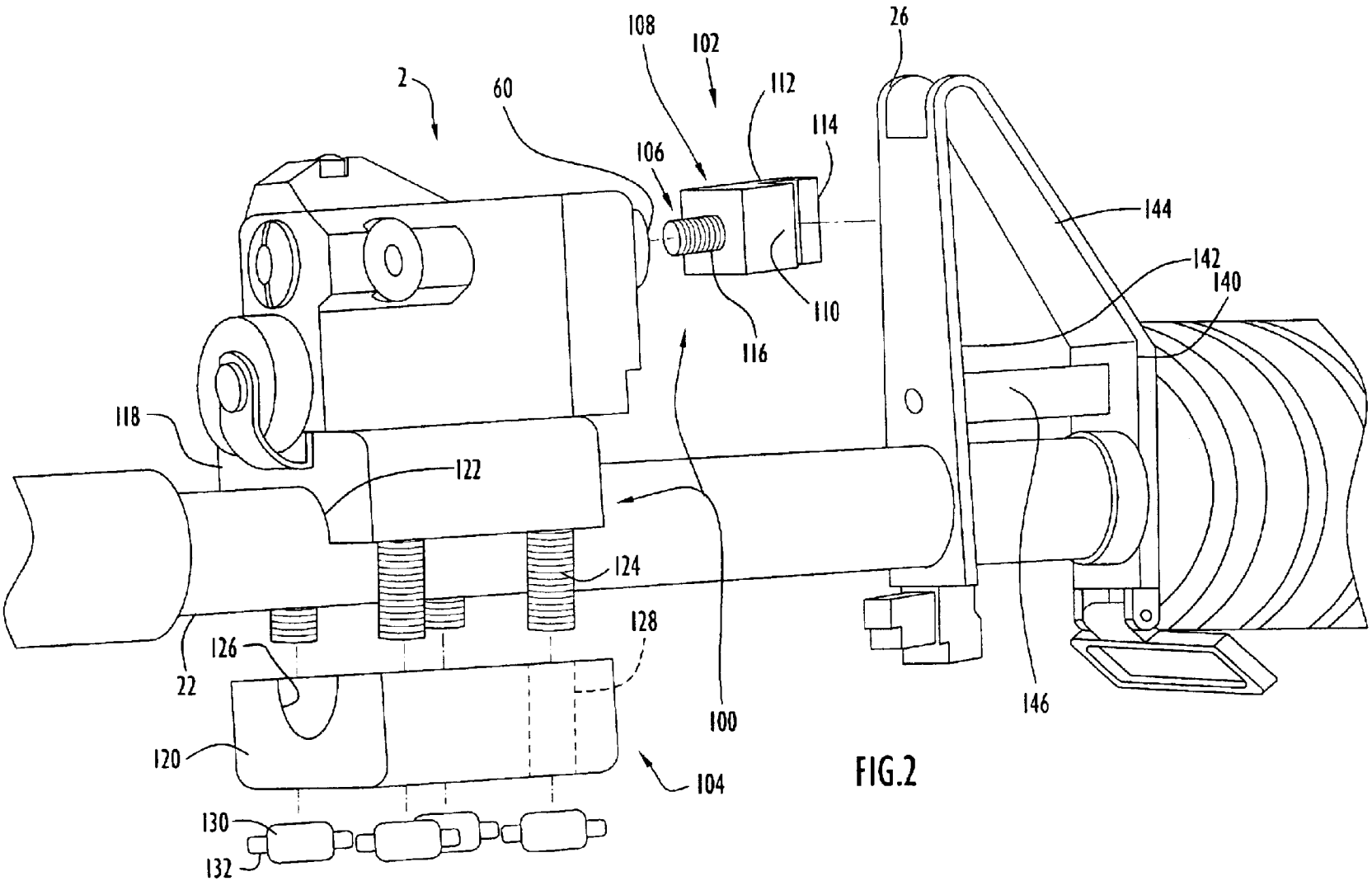
FIG. 2 is an exploded perspective view of a mounting bracket securing a laser transmitter assembly to a firearm barrel and front sight according to the present invention.

Laser transmitter assembly 2 is preferably secured to the firearm barrel and front sight via mounting bracket 100 as illustrated in FIG. 2. Specifically, mounting bracket 100 includes a sight member 102 and a barrel clamp 104. The barrel clamp secures the laser assembly to barrel 22, while sight member 102 is removably attached to the laser assembly and engages front sight 26. The sight member includes a post 106 and a hook member 108 having a base 110, an intermediate section 112 and a projection 114. The base and projection are each substantially rectangular and extend substantially in parallel while being spaced apart a slight distance. Intermediate section 112 is substantially rectangular and is attached to and disposed between base 110 and projection 114 to interconnect these components. Base 110 and projection 114 transversely extend from opposing ends of intermediate section 112 with the base extending from that section for a distance substantially greater than that of the projection.

The base, intermediate section and projection are basically arranged in a generally 'C' type configuration and collectively define an open interior to facilitate engagement with front sight 26. In particular, the front sight typically includes proximal and distal bars 140, 142 each extending upwards from the barrel, where the laser assembly is typically positioned along the barrel distally of and proximate distal bar 142. Proximal bar 140 has a height significantly less than that of distal bar 142, while an intermediate bar 144 is attached to and interconnects the proximal and distal bar top edges. A support bar 146 is further attached to and between intermediate sections of proximal and distal bars 140, 142. The distance between base 110 and projection 114 is slightly greater than the thickness of distal bar 142, thereby enabling hook member 108 to capture and engage a portion of the distal bar between the base and projection.

Post 106 is attached to and extends distally from the approximate center of base 110. The post includes external threads 116 that facilitate engagement with threaded opening 60 of the laser transmitter assembly. The sight member secures the laser transmitter assembly to front sight 26, thereby preventing rotation of the laser transmitter assembly about barrel 22 during firearm operation.

Barrel clamp 104 secures the laser transmitter assembly to barrel 22 and includes upper and lower members 118, 120. Upper member 118 is in the form of a generally rectangular block having a substantially central recess or channel 122 defined therein and extending along the upper member longer dimension. The recess is generally in the form of an inverted "U"-shape (e.g., as viewed in FIG. 2) having sufficient dimensions to contour and receive a portion of barrel 22. Laser transmitter assembly 2 is typically attached to the upper member top surface via conventional fastening mechanisms (e.g. bolt, screw, etc). The upper member further includes a series of threaded bolts 124 that are each attached to the upper member bottom surface proximate a respective corner of that surface. The bolts facilitate engagement of upper member 118 with lower member 120 to secure the laser assembly to the barrel as described below.

Lower member 120 is similar to the upper member and is in the form of a generally rectangular block having a substantially central recess or channel 126 defined therein and extending along the lower member longer dimension. The recess is similar to recess 122 described above and is generally "U"-shaped (e.g., as viewed in FIG. 2) having sufficient dimensions to contour and receive a portion of barrel 22. A series of channels 128 are each defined toward a respective corner of the lower member and extend between the lower member top and bottom surfaces. The channels each receive a corresponding upper member bolt 124 to facilitate engagement of the lower member with the upper member. In particular, the upper and lower members are positioned about barrel 22 with upper member recess 122 positioned coincident lower member recess 126 and upper member bolts 124 aligned with corresponding lower member channels 128. The upper and lower members are moved toward each other and the barrel, thereby enabling upper member bolts 124 to traverse corresponding lower member channels 128 and enabling the aligned recesses to collectively form a generally cylindrical channel that receives and engages the barrel. The bolts each have a sufficient length to traverse the corresponding channel and extend beyond the lower member bottom surface. A plurality of fasteners or nuts 130 are each disposed on a respective bolt 124 extending through and beyond a lower member channel. The fasteners each include internal threads (not shown) configured to engage the threads of a corresponding upper member bolt. The fasteners are manipulated to engage and traverse the threads of the upper member bolts to securely fasten the upper and lower members to each other and to the barrel. In addition, the fasteners may each include grip members 132 (e.g., wings, etc.) to facilitate enhanced manipulation of that fastener relative to a corresponding bolt.

In operation, the laser transmitter assembly is attached to upper member 120, while sight member 102 is attached to the laser transmitter assembly via post 106 and laser assembly opening 60 as described above. The laser assembly and upper member are positioned along and above the barrel to enable the sight member to engage the front sight distal bar as described above. Lower member 120 is positioned below the upper member and barrel with lower member recess 126 and channels 128 aligned with upper member recess 122 and bolts 124 as described above. The upper and lower members are moved toward each other and the barrel to enable the barrel to be disposed in the upper and lower member recesses and to facilitate traversal of the lower member channels by upper member bolts 124. Fasteners 130 are each disposed on a corresponding bolt 124 and manipulated to secure the upper and lower members to each other, thereby securing the laser assembly to the barrel and front sight for simulation of firearm operation.

With reference to FIG. 1, during normal operation of firearm 6, a live cartridge including a projectile (e.g., a bullet) and an explosive substance (e.g., any of various types of conventional gun or other explosive powders) is placed into position within the firearm by the bolt assembly and carrier. The bolt assembly initially receives a new cartridge from the magazine, while the carrier is urged distally to position the cartridge in the barrel for firing. The bolt assembly rotates during carrier motion to be placed in locking engagement with the upper receiver for firing the cartridge. Trigger 16 is actuated to cause the explosive substance to fire the projectile through the barrel. When the projectile passes gas port 34, gas created from the reaction of the explosive substance flows into the gas port and is directed toward the bolt carrier via a gas tube (not shown). The directed gas forces the bolt carrier proximally, thereby causing rotation and unlocking of the bolt assembly from the upper receiver. The bolt carrier and unlocked bolt assembly both move proximally toward ejection port 35, thereby enabling the bolt assembly to eject the current or spent cartridge shell from the firearm through the ejection port. Once the bolt carrier has ceased proximal motion due to the gases and carrier inertia, a spring (not shown) disposed within the stock urges the bolt carrier distally to enable the bolt assembly to rotate and engage a new cartridge forced into the upper receiver by magazine 20 via a magazine spring (not shown). The bolt assembly and carrier return to their original positions to place the new cartridge into position for firing as described above. Thus, the gas created from the reaction of the explosive substance of each cartridge enables the firearm to automatically cycle to fire a succeeding cartridge. The manner of operation of firearm 6 is similar to that disclosed in U.S. Pat. No. 2,951,424 (Stoner), the disclosure of which is incorporated herein by reference in its entirety.

Figure 3:
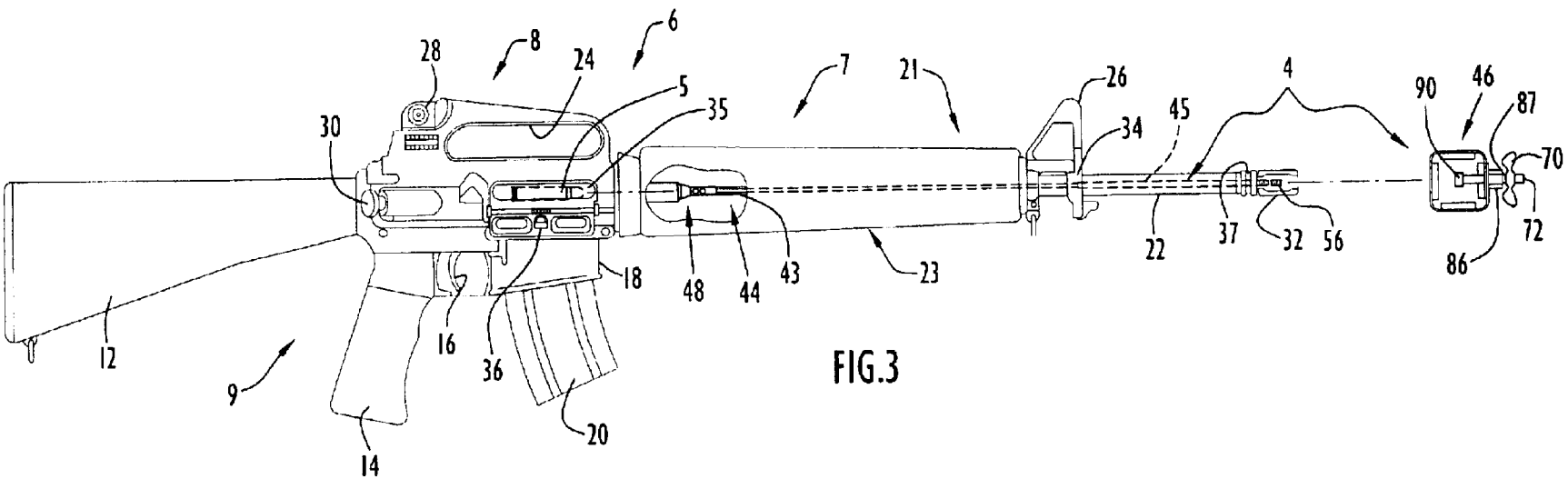
FIG. 3 is an exploded view in perspective of a cartridge adapter assembly of the system of FIG. 1 disposed within a firearm according to the present invention.

In order to adapt firearm 6 for compatibility with the training system, cartridge adapter assembly 4 is disposed within firearm 6 as illustrated in FIG. 3. Specifically, cartridge adapter assembly 4 includes a barrel member 44 and a bracket 46. The barrel member is inserted within barrel 22 and extends from a proximal portion of the barrel toward the distal end of flash suppressor 32. A limiter 48 is attached to the barrel member proximal end and is configured to engage the distal end of modified cartridge 5, while enabling gas created from firing the cartridge to traverse the barrel as described below. Bracket 46 is configured to engage the barrel member and a distal section of the flash suppressor to secure the barrel member in position during firearm simulation as described below.

Figure 4:
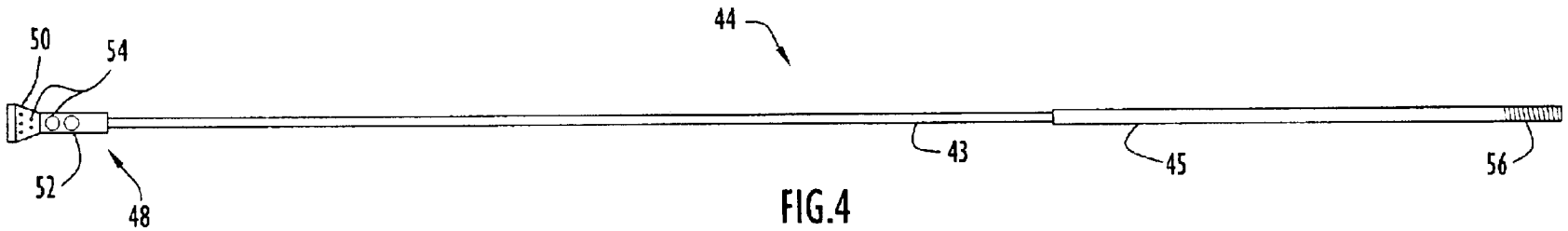
FIG. 4 is a view in perspective of a cartridge adapter assembly barrel member of the system of FIG. 3 for accommodating modified blank cartridges according to the present invention.
Figure 6:
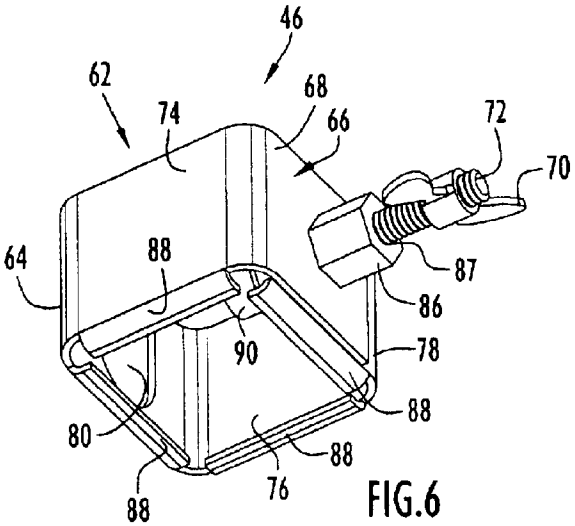
FIG. 6 is a bottom perspective view of the cartridge adapter assembly bracket of FIG. 5.
Figure 5:
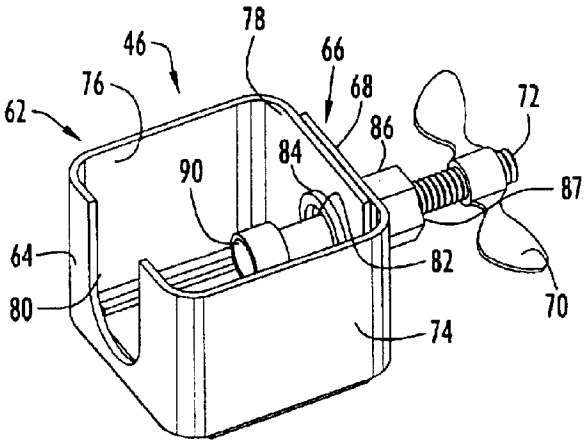
FIG. 5 is a view in perspective of a cartridge adapter assembly bracket of the system of FIG. 3 for maintaining the barrel member position within the firearm.

Referring to FIGS. 3–4, barrel member 44 includes substantially cylindrical rod members 43, 45. Member 43 is disposed at a proximal portion of the barrel member and includes limiter 48 attached to the proximal end of rod member 43. Limiter 48 includes a generally cylindrical base 52 having a proximal frusto-conical tip 50 for accommodating the distal tip of modified cartridge 5. The transverse cross-sectional dimensions of base 52 are greater than those of member 43, while the transverse cross-sectional dimensions of tip 50 expand proximally from the base. Tip 50 and base 52 each include a series of openings or holes 54 defined therein to permit gas from a fired cartridge to flow through those holes and along barrel 22. Rod member 45 is disposed at a distal portion of the barrel member and has a length shorter than that of rod member 43. The transverse cross-sectional dimensions of rod member 45 are greater than those of rod member 43 to form a shoulder where the rod members meet. The distal end of rod member 45 includes threads 56 to engage bracket 46 and secure the barrel member in position within the barrel as described below.

In order to simulate firearm operation, the barrel member is inserted within firearm barrel 22 with limiter 48 disposed toward the barrel proximal end. Rod member 43 extends within the barrel from limiter 48 to gas port 34, while rod member 45 extends from the distal end of rod member 43 into the confines of flash suppressor 32. Rod member 43 has transverse cross-sectional dimensions substantially less than those of the barrel to permit gases from a fired cartridge to traverse the barrel and enter the gas port to cycle the firearm. The transverse cross-sectional dimensions of rod member 45 are slightly less than those of the barrel in order to direct gases traversing the barrel into the gas port and thereby minimize gas emitted by the firearm. In other words, rod member 43 enables the gases to flow along the barrel to the gas port, while rod member 45 impedes further traversal and directs the gases into the gas port for cycling of the firearm. The rod members may be of any shape or size to accommodate firearms having varying dimensions and calibers, and gas ports disposed at various locations. For example, rod member 45 may have cross-sectional dimensions slightly less than 5.56 millimeters to accommodate a conventional twenty-two caliber firearm, or slightly less than nine millimeters to accommodate a conventional nine millimeter firearm. In addition, the limiter may be of any shape or size to accommodate variously configured modified cartridges.

Bracket 46 is disposed at a flash suppressor distal end and engages rod member 45 to secure barrel member 44 in position within the firearm. Referring to FIGS. 3–6, bracket 46 includes a frame 62 and a connecting rod 72 inserted through the frame. Frame 62 includes front and rear walls 64, 66 and side walls 74, 76, each substantially rectangular and collectively defining a frame interior having open top and bottom portions. The frame includes rounded corners at the junctions where the front and side walls meet, while rear wall 66 includes a pair of overlapping projections 68, 78. Projection 68 extends from side wall 74 toward side wall 76 for a distance slightly less than the distance between the side walls. Similarly, projection 78 extends from side wall 76 toward side wall 74 in front of projection 68 for a distance slightly less than the distance between the side walls. The projections form rounded corners with the respective side walls at the junctions where the side walls and projections meet.

Front wall 64 includes a "U"-shaped recess 80 defined at the approximate center of that wall. The recess extends from the front wall upper edge toward the bottom edge of that wall for a distance slightly less than the front wall height. The transverse dimensions of the recess are slightly greater than those of the flash suppressor to enable the recess edges to be disposed within a flash suppressor groove as described below.

An opening 82 is defined through the approximate centers of rear wall projections 68, 78 for receiving connecting rod 72. The opening transverse cross-sectional dimensions are slightly greater than those of the connecting rod, while a reinforcing ring 84 is defined in projection 78 about opening 82 to reinforce that opening. A generally hexagonal extension 86 is attached to projection 68 and extends rearward from the projection. The extension includes a substantially circular threaded opening 87 having transverse cross-sectional dimensions slightly less than those of opening 82. The frame front and side walls and rear wall projection 78 each include a substantially rectangular ledge 88 extending from a bottom edge of that wall. Each ledge 88 forms a rounded edge at the junction where the ledge and corresponding wall or projection meet. The ledges each occupy a substantial portion of a corresponding wall or projection bottom edge and extend substantially perpendicular to the corresponding wall or projection into the frame interior for a slight distance to reinforce and provide support for the frame.

Connecting rod 72 is generally cylindrical having a threaded distal portion and a receiving member 90 attached to the rod proximal end. The receiving member is substantially cylindrical having transverse cross-sectional dimensions slightly greater than those of rod 72 and extension opening 87, but less than those of opening 82. The receiving member dimensions form a tilted shoulder where the rod and the receiving member meet. A frusto-conical recess is formed within receiving member 90 with a substantially circular threaded opening (not shown) defined at the recess bottom. The threaded opening has transverse cross-sectional dimensions slightly greater than those of rod member 45 and enables the connecting rod to engage threads 56 of that rod member.

Connecting rod 72 is disposed through opening 82 with receiving member 90 positioned proximally of extension 86. The dimensions of receiving member 90 and extension opening 87 serve as a stop to prevent the connecting rod from being drawn distally through opening 87. The connecting rod slides within opening 82 to enable its threaded distal portion to engage threaded extension opening 87, thereby maintaining the connecting rod position and securing the cartridge adapter assembly within firearm 6. Specifically, bracket 46 is placed on the flash suppressor when barrel member 44 is disposed in the barrel as described above. Rod 72 is manipulated to enable receiving member 90 to engage rod member 45, while the connecting rod threaded portion engages threaded extension opening 87. The connecting rod is rotated to enable its threaded distal portion to engage the extension, while the receiving member threaded opening secures rod member 45. A threaded wing nut 70 is disposed on the connecting rod distally of extension 86 to lock the barrel member in place within the firearm. The bracket secures the barrel member sufficiently to prevent movement during firing of the modified cartridges. Laser transmitter assembly 2 may be attached to the threaded portion of connecting rod 72 distally of wing nut 70 via threaded opening 60 (FIG. 1). In particular, the connecting rod threaded distal portion may be configured to be compatible with the laser assembly threaded opening and is inserted into that opening to fasten the laser assembly to the connecting rod. The cartridge adapter assembly facilitates use of a user firearm for training, while reducing the amount of time required to prepare that firearm for training.

Modified cartridge 5 (FIG. 3) is typically configured to be distinguishable from a live blank or round. In particular, the cartridge preferably has a length shorter than that of a live blank or round. Alternatively, the modified cartridge tip may be configured for a mated engagement with limiter 48. For example, the modified cartridge tip may be of any shape (e.g., conical, polygonal, etc.) and/or include various configurations (e.g., hollow, include a recess, include indicia, grooves, notches or post patterns defined therein, etc.), while the limiter is configured to specifically engage the modified cartridge tip. In this fashion, live blanks or rounds or other types of incompatible cartridges can not physically be loaded into the firearm due to the configuration of the cartridge adapter assembly.

The modified cartridges are generally in the shape of a live round, but each contain a quantity of an explosive substance (e.g., any of various types of conventional gun or other explosive powders) sufficient only to cycle the firearm as described above. In other words, the quantity of explosive substance is sufficient to provide only the appropriate amount of pressurized gas to manipulate the bolt assembly and carrier distally to eject the spent shell and load a new cartridge as described above. Thus, the modified cartridges provide recoil and automatic firearm cycling at reduced cost since the modified cartridges contain only an amount of explosive substance sufficient to cycle the firearm (e.g., which is significantly less than the quantity of substance utilized in a blank or a live round that must propel a projectile). The amount of explosive substance within a modified cartridge is based on several factors including the particular firearm utilizing that cartridge, the quantity of force required to cycle the firearm and the energy produced by the substance. By way of example only, a modified cartridge for an M16 rifle generally includes a quantity of an explosive substance in the approximate range of 5–8 grains, while a live round typically includes fifty or more grains of that same type of substance. In addition, the modified cartridge may be configured to permit usage of a firearm with various accessories. For example, if the firearm utilizes a magazine or feed belt, the modified cartridge may be configured for use with those accessories.

Operation of the firearm laser training system is described with reference to FIGS. 1–6. Initially, a user firearm 6 is adapted for use with the system and, by way of example only, is implemented by an M16 rifle. In particular, a back or takedown pin is removed from the firearm to enable upper receiver 8 to pivot relative to lower half 9, thereby providing access to the firearm interior. The charging handle (not shown) and bolt assembly are removed from upper receiver 8, while barrel member 44 is inserted through the upper receiver and into barrel 22 with limiter 48 positioned toward the barrel proximal end and the threaded section of rod member 45 disposed within the confines of flash suppressor 32. Bracket 46 is mounted on the flash suppressor with the edges of recess 80 placed within one of the flash suppressor grooves 37 and receiving member 90 inserted into the flash suppressor to engage the threaded section of rod member 45. Connecting rod 72 is manipulated to enable the receiving member threaded opening to securely engage threads 56 of rod member 45. The bolt assembly and charging handle are subsequently restored in the upper receiver, while the takedown pin is re-inserted to reassemble the firearm. A sample or spent modified blank cartridge is loaded into the firearm to enable the firearm to be charged via the bolt assembly and charging handle as described below.

Typically, the initial position of the cartridge adapter assembly within the firearm prevents the bolt assembly from being placed in locking engagement with the upper receiver. In other words, the bolt assembly is not able to fully urge the modified blank cartridge into the barrel due to the position of barrel member 44. Accordingly, connecting rod 72 of bracket 46 is manipulated to distally traverse threaded extension opening 87. As the connecting rod distally traverses opening 87, the barrel member is drawn distally into the barrel by receiving member 90, thereby enabling the loaded cartridge to further penetrate the barrel. This adjustment process is repeated until the loaded modified cartridge may be fully urged into the appropriate position within the barrel for firing. In order to verify the cartridge adapter assembly position, the charging handle is utilized to manipulate the bolt assembly and carrier to eject the loaded modified cartridge through the ejection port. A successfully ejected cartridge indicates a correct position of the cartridge adapter assembly within the firearm. However, when the loaded cartridge does not eject, the above-described process is repeated to place the cartridge adapter assembly into an appropriate position and enable ejection of the loaded cartridge.

Once the cartridge adapter assembly has attained the correct position, wing nut 70 is placed on the connecting rod to lock the cartridge adapter assembly in that position. Laser assembly 2 may be attached to barrel 22 and front sight 26 as described above at any time prior to or during insertion of the cartridge adapter assembly within the firearm. Alternatively, the laser assembly may be disposed on connecting rod 72 distally of the wing nut or be attached to the upper receiver handle as described above. A user loads firearm 6 with modified cartridges 5, via magazine 20, and manipulates the charging handle to place an initial modified cartridge in position for firing. The modified cartridges include a quantity of explosive substance sufficient only to provide recoil and enable gases from the firing to cycle the firearm as described above. The user actuates trigger 16 to successively fire the modified cartridges within magazine 20 as described above. Laser assembly 2 senses trigger actuation and emits a laser pulse toward target 10 in response to firing of each modified cartridge as described above. The target detects and displays simulated projectile impact locations as described above. Alternatively, the laser assembly may be operated in a mode to continuously emit a laser beam for aligning sights or providing information about user handling of the firearm as described above.

In order to remove the cartridge adapter assembly, the takedown pin is removed from the firearm and the upper receiver is pivoted relative to the lower half to provide access to the firearm interior and facilitate removal of the bolt assembly and charging handle as described above. Wing nut 70 and laser assembly 2 (e.g., if attached to the connecting rod) are removed from the connecting rod, while the connecting rod is manipulated to disengage rod member 45 from receiving member 90, thereby enabling removal of bracket 46. Barrel member 44 is subsequently removed from the barrel through the upper receiver and the firearm is re-assembled for use with conventional blanks or live rounds.

It will be appreciated that the embodiments described above and illustrated in the drawings represent only a few of the many ways of implementing a firearm laser training system and method employing modified blank cartridges for simulating operation of a firearm.

The firearm laser training system may be utilized with any semi-automatic, fully automatic or other type of firearm (e.g., hand-gun, rifle, shotgun, machine gun, etc.), while the laser assembly may be fastened to the firearm at any suitable locations via any conventional or other fastening techniques (e.g., frictional engagement with the barrel, brackets attaching the device to the firearm, etc.). Further, the system may include replaceable firearm components (e.g., a barrel) having a laser device disposed therein for firearm training. The laser device may be utilized for firearm training on objects other than the target.

The computer system of the laser training system may be implemented by any type of conventional or other computer system, and maybe connected to any quantity of other firearm training computer systems via any type of network or other communications medium to facilitate plural user training sessions or competitions. The computer system may include any type of printing device, display and/or user interface to provide any desired information relating to a user session.

The system may be utilized with any types of targets (e.g., targets visibly reflecting the beam, having detectors to detect the beam, etc.) of any shape or size and/or other firearm laser training systems, such as those disclosed in the aforementioned patent applications and U.S. Provisional Patent Application Ser. No. 60/175,829, entitled "Firearm Simulation and Gaming System and Method for Operatively Interconnecting a Firearm Peripheral to a Computer System" and filed Jan. 13, 2000; Ser. No. 60/175,882, entitled "Laser Transmitter Assembly Configured for Placement Within a Firing Chamber to Simulate Firearm Operation" and filed Jan. 13, 2000; Ser. No. 60/175,987, entitled "Firearm Laser Training System and Kit Including a Target Structure Having Sections of Varying Reflectivity for Visually Indicating Simulated Projectile Impact Locations" and filed Jan. 13, 2000; Ser. No. 60/205,811, entitled "Firearm Laser Training System and Method Employing an Actuable Target Assembly" and filed May 19, 2000; and Ser. No. 60/210,595, entitled "Firearm Laser Training System and Method Facilitating Firearm Training with Various Targets" and filed Jun. 9, 2000; the disclosures of which are incorporated herein by reference in their entireties.

The laser assembly may emit any type of laser beam within suitable safety tolerances. The laser beam may be visible or invisible (e.g., infrared), may be of any color or power level, may have a pulse of any desired duration and may be modulated in any fashion (e.g., at any desired frequency or unmodulated) or encoded in any manner to provide any desired information, while the transmitter may project the beam continuously or include a "constant on" mode. The laser assembly may include any type of switch or other device disposed at any suitable locations (e.g., on the assembly, firearm, etc.) to switch between training, "constant on" or other operational modes. The system may be utilized with transmitters and detectors emitting any type of energy (e.g., light, infrared, etc.). The laser assembly housing may be of any shape or size, and may be constructed of any suitable materials. The opening may be defined in the laser assembly housing at any suitable locations. Alternatively, the housing may include any conventional or other fastening devices (e.g., threaded attachment, hook and fastener, frictional engagement with the opening, etc.) to attach the assembly to the firearm. The optics package may include any suitable lens of any quantity for projecting the beam. The laser assembly maybe fastened to a firearm at any suitable locations (e.g., external or internal of a barrel, proximate a front sight, upper receiver handle, distal end of barrel, etc.) via any conventional or other fastening techniques (e.g., frictional engagement with the barrel, brackets attaching the device to the firearm, etc.) and may be actuated by a trigger or any other device (e.g., power switch, firing pin, relay, etc.). The laser assembly may include any type of sensor or detector (e.g., acoustic sensor, piezoelectric element, accelerometer, solid state sensors, strain gauge, etc.) to detect mechanical or acoustical waves or other conditions signifying trigger actuation. The laser assembly components may be arranged within the housing in any fashion, while the laser assembly power source may be implemented by any type or quantity of batteries. Alternatively, the laser assembly may include a power adapter for receiving power from a common wall outlet jack or other power source.

The laser assembly mounting bracket may be of any quantity, shape or size and may be constructed of any suitable materials. The sight member and corresponding components (e.g., hook member, base, intermediate section, projection, etc.) maybe of any quantity, shape or size and may be constructed of any suitable materials. The hook member may include any configuration to capture and engage any portion of the front sight or any other firearm portion. The base, intermediate section and projection may be arranged in any fashion to engage any portion of the front sight or any other firearm portion. The post may be of any quantity, shape or size, may be constructed of any suitable materials and may be disposed at any suitable locations on the hook member. The hook member may engage the laser transmitter assembly in any desired fashion via any conventional or other fastening mechanisms (e.g., brackets, hooks, clamps, etc.).

The barrel clamp may be of any quantity, shape or size, may be constructed of any suitable materials and may secure the laser transmitter assembly to any portion of the barrel or other firearm portion. The upper and lower members may each be of any quantity, shape or size and may be constructed of any suitable materials. The upper and lower members may engage each other via any conventional or other securing mechanisms (e.g., nuts and bolts, clamps, fasteners, etc.). The upper and lower member recesses, bolts and channels may be of any quantity, shape or size and may be disposed at any suitable locations. The bolts or other fastening devices may be attached to either or both of the upper member and lower members in any desired combination or fashion. Alternatively, the upper member may include a series of channels similar to those of the lower member where independent bolts or other fasteners may be inserted through the upper and lower member channels to secure the upper and lower members to each other. The laser transmitter assembly may be attached to either or both of the upper and lower members via any conventional or other fastening techniques, and may be secured to the firearm with or without use of the sight member. The barrel clamp may secure the laser assembly to the barrel at any desired orientation. The fasteners may be of any quantity shape or size and may include any configuration to engage the upper member bolts to secure the upper and lower members to each other. The fasteners may include any quantity of any type of gripping member (e.g., wings, rubberized grip, etc.) disposed at any suitable locations to facilitate manipulation of the fastener relative to a bolt. The upper and lower members may be positioned and secured to the barrel in any desired order or fashion (e.g., the lower member may be initially positioned where the upper member is aligned with the lower member, etc.).

The cartridge adapter assembly barrel member may be of any quantity, shape or size and may be constructed of any suitable materials. The rod members and limiter of the barrel member may be of any quantity, shape or size, and may be constructed of any suitable materials. The rod members may include any dimensions or configurations to accommodate any firearm caliber and any locations of firearm gas ports. The limiter (e.g., base, tip, etc.) and modified cartridge may include any compatible configurations. The limiter base and tip may be of any quantity, shape or size and may be constructed of any suitable materials. The limiter base and tip may include any quantity of openings of any shape or size disposed at any locations.

The cartridge adapter assembly bracket may be of any quantity, shape or size, may be utilized at any locations (e.g., internal or external of the firearm) in any orientations, and may be constructed of any suitable materials. The bracket frame, walls, rear wall projections and ledges maybe of any quantity, shape or size, and maybe constructed of any suitable materials. The ledges may be disposed at any suitable locations on the frame. The rear wall projections may overlap in any fashion. Alternatively, the rear wall projections may not overlap or be implemented by an integral rear wall. The frame recess may be of any quantity shape or size and may be disposed at any suitable locations on the frame. The bracket may utilize any type of fastening structure to lock the cartridge adapter assembly in position. The bracket and barrel member may include any compatible configurations to secure the barrel member to the bracket.

The bracket rear wall extension, extension opening, ring and opening may be of any quantity, shape or size, and may be disposed at any suitable locations on the frame. The bracket and extension opening may include any types of fastening devices to engage the connecting rod, rod members or wing nut. The wing nut may be of any quantity, size or shape and maybe implemented by any conventional or other types of nuts or fastening devices. The connecting rod and receiving member may be of any quantity, shape or size, and may be constructed of any suitable materials. The receiving member opening and recess may be of any shape or size, may be disposed at any suitable locations and may include any type of fastening device to engage the barrel member.

The modified blank cartridges may be of any quantity, shape or size, and may be constructed of any suitable materials. However, the modified blank cartridges preferably include configurations different than those of conventional blank cartridges and live ammunition. The cartridges may include any quantity of any conventional or other explosive substances sufficient to cycle the firearm, preferably substantially less than the quantities utilized for blank or live rounds. For example, the cartridges may include any quantity of explosive substance ranging from the same quantity of explosive substance to as low as approximately one tenth of the quantity of explosive substance utilized by a corresponding live or blank cartridge for a particular firearm. Further, the modified blank cartridges may include any configurations compatible with the limiter and/or for use with any types of firearm accessories (e.g., magazines, feed belts, etc.).

From the foregoing description, it will be appreciated that the invention makes available a novel firearm laser training system and method employing modified blank cartridges for simulating operation of a firearm wherein a laser training system employs modified blank cartridges each having a quantity of explosive substance sufficient only to cycle a firearm and a laser transmitter assembly attachable to the firearm for projecting a laser beam therefrom to simulate firearm operation.

Having described preferred embodiments of a new and improved firearm laser training system and method employing modified blank cartridges for simulating operation of a firearm, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. In a firearm training system including a laser transmitter assembly secured to a firearm to emit a laser beam in response to actuation of said firearm to simulate firearm operation, wherein said firearm includes a barrel and a sight disposed along said barrel to facilitate user aim of said firearm, a mounting unit to secure said laser transmitter assembly to said firearm comprising:

a barrel securing member to receive said laser transmitter assembly and engage said barrel to secure said laser transmitter assembly to said barrel, wherein said barrel securing member includes:

a first block having a first recess defined therein and configured to receive a first portion of said barrel;

a second block having a second recess defined therein and configured to receive a second portion of said barrel; and at least one securing member extending through said first and second blocks to secure said first and second blocks to each other, wherein said laser transmitter assembly is attached to said first block and said first and second blocks are positioned coincident each other about said barrel and receive said barrel within said first and second recesses in response to said at least one securing member securing said first and second blocks to each other; and a sight securing member attached to said laser transmitter assembly to engage a portion of said firearm sight;

wherein said mounting unit secures said laser transmitter assembly to said barrel and said sight to prevent rotation of said laser transmitter assembly about said barrel during simulation of firearm operation.

2. In a firearm training system including a laser transmitter assembly secured to a firearm to emit a laser beam in response to actuation of said firearm to simulate firearm operation, wherein said firearm includes a barrel and a sight disposed along said barrel to facilitate user aim of said firearm, a mounting unit to secure said laser transmitter assembly to said firearm comprising:

a barrel securing member to receive said laser transmitter assembly and engage said barrel to secure said laser transmitter assembly to said barrel; and a sight securing member attached to said laser transmitter assembly to engage a portion of said firearm sight, wherein said sight securing member includes:

an assembly sight member to engage said laser transmitter assembly; and a hook member attached to said assembly sight member to engage a portion of and secure said laser transmitter assembly to said sight, wherein said hook member includes:

an intermediate portion;

a base extending transversely from a first end of said intermediate portion and having said assembly sight member attached thereto; and a projection extending from a second end of said intermediate section and spaced apart from said base, wherein said hook member engages said sight portion between said base and said projection;

wherein said mounting unit secures said laser transmitter assembly to said barrel and said sight to prevent rotation of said laser transmitter assembly about said barrel during simulation of firearm operation.

3. In a firearm training system including a laser transmitter assembly secured to a firearm to emit a laser beam in response to actuation of said firearm to simulate firearm operation, wherein said firearm includes a barrel and a sight disposed along said barrel to facilitate user aim of said firearm, a mounting unit to secure said laser transmitter assembly to said firearm comprising:

barrel securing means for receiving said laser transmitter assembly and engaging said barrel to secure said laser transmitter assembly to said barrel, wherein said barrel securing means includes:

a first block having a first recess defined therein and configured to receive a first portion of said barrel;

a second block having a second recess defined therein and configured to receive a second portion of said barrel; and block securing means extending through said first and second blocks to secure said first and second blocks to each other, wherein said laser transmitter assembly is attached to said first block and said first and second blocks are positioned coincident each other about said barrel and receive said barrel within said first and second recesses in response to said block securing means securing said first and second blocks to each other; and sight securing means attached to said laser transmitter assembly for engaging a portion of said firearm sight;

wherein said mounting unit secures said laser transmitter assembly to said barrel and said sight to prevent rotation of said laser transmitter assembly about said barrel during simulation of firearm operation.

4. In a firearm training system including a laser transmitter assembly secured to a firearm to emit a laser beam in response to actuation of said firearm to simulate firearm operation, wherein said firearm includes a barrel and a sight disposed along said barrel to facilitate user aim of said firearm, a mounting unit to secure said laser transmitter assembly to said firearm comprising:

barrel securing means for receiving said laser transmitter assembly and engaging said barrel to secure said laser transmitter assembly to said barrel; and sight securing means attached to said laser transmitter assembly for engaging a portion of said firearm sight, wherein said sight securing means includes:

assembly sight means for engaging said laser transmitter assembly; and hook means attached to said assembly sight means for engaging a portion of and securing said laser transmitter assembly to said sight, wherein said hook means includes:

an intermediate portion;

a base extending transversely from a first end of said intermediate portion and having said assembly sight means attached thereto; and a projection extending from a second end of said intermediate section and spaced apart from said base, wherein said hook means engages said sight portion between said base and said projection;

wherein said mounting unit secures said laser transmitter assembly to said barrel and said sight to prevent rotation of said laser transmitter assembly about said barrel during simulation of firearm operation.

* * * * *